US005911216A

United States Patent [19]

Killian

[11] Patent Number: 5,911,216

[45] Date of Patent: Jun. 15, 1999

[54] SELF-STOWING BOW CARRYING SYSTEM

[76] Inventor: Dana D. Killian, 4062 E. 300 North, Rigby, Id. 83442

[21] Appl. No.: 09/015,034

[22] Filed: Jan. 28, 1998

[51] Int. Cl.[6] ..... F41B 5/14

[52] U.S. Cl. ..... 124/86; 224/162; 224/916

[58] Field of Search ..... 124/1, 23.1, 86, 124/88; 224/162, 916; 248/682, 685, 693

[56] References Cited

U.S. PATENT DOCUMENTS

| | | | |
|---|---|---|---|
| 2,441,902 | 5/1948 | Powell | 224/258 |
| 2,614,355 | 10/1952 | Rogers et al. | 42/85 |
| 3,055,354 | 9/1962 | Gates | 124/23.1 X |
| 3,193,212 | 7/1965 | Lotta | 242/379.2 |
| 3,204,626 | 9/1965 | Morneau | 124/23.1 |
| 3,741,092 | 6/1973 | Bohanec | 224/257 |
| 3,998,367 | 12/1976 | Harding | 124/23.1 X |
| 4,553,715 | 11/1985 | Roselli | 242/396.1 |
| 4,658,999 | 4/1987 | Hilty | 224/609 |
| 4,754,904 | 7/1988 | Fischer et al. | 224/259 |
| 4,760,944 | 8/1988 | Hughes | 224/609 |
| 4,768,689 | 9/1988 | Davis | 224/257 |
| 5,065,732 | 11/1991 | Smith | 124/88 |
| 5,165,584 | 11/1992 | Meagher et al. | 124/88 X |
| 5,499,752 | 3/1996 | Johnson | 124/88 X |
| 5,513,621 | 5/1996 | Vanskiver | 124/86 |

*Primary Examiner*—John A. Ricci
*Attorney, Agent, or Firm*—Fitch, Even, Tabin & Flannery

[57] ABSTRACT

An archer's bow includes a riser between upper and lower limbs, and secured to limbs with bolt fasteners. A housing contains a spool with flexible webbing would thereon. A leg extends at an acute angle to the housing and includes an aperture for securement to one of the bolt fasteners. Webbing extends through an opening in the housing and is wound to one side of the riser so as to be maintained clear of the sight window. The webbing automatically retracts when worn by a user to adjust tension in the webbing as a bow is carried while climbing or running. Further, the webbing automatically retracts immediately upon dismount and clears the sight window before even a quick shot can be taken.

8 Claims, 6 Drawing Sheets

76
11
84
94
11
84
96
94
90
99
98
116
126
106
110
112
113
114
108
82
82
142
130
122
74
70
140
94
84
95
92
76

SELF-STOWING BOW CARRYING SYSTEM

BACKGROUND OF THE INVENTION

1. Field of the Invention

This invention relates to archery equipment and, more particularly, to a bow carrying system that provides an automatically adjusting fit and which can be attached to a bow for automatic stowing in a manner which does not require the archer's attention.

2. Description of the Related Art

An archer may not require a sling on days when the bow need not be carried, as during brief practice sessions at a designated range. However, persons which use the bow for practical activities, such as hunting and competition events, particularly those involving orienteering skills, require use of the bow only on an infrequent basis. When the bow is not in use, it must be carried by the archer along with other equipment during a trip into the field. It is important during such times that the archer have the use of both hands to negotiate obstacles such as steeply sloping terrain. It is desirable in such instances that the bow be carried on the archer's person in a manner which not only avoids the need for constant attention by the archer, but which also adjusts to the archer's full range of motions. While certain slings have been proposed over the years, they do not provide the necessary self-adjusting tension while on the archer's body.

As those skilled in the art of bow hunting and simulated competition events are aware, the effective range of an archery bow, even a state-of-the-art compound bow, is limited. Accordingly, hunting activities require special skills, allowing the archer to be as silent as possible to avoid audible detection. Oftentimes, it is not feasible to have the bow dismounted from the carry position and it is important in these instances that the bow be made available to the archer for accurate shooting, as quickly as possible. Accordingly, there is a need for providing a carry system for an archery bow which is not only self-adjusting despite a wide range of archer's movements, but which also is "transparent" in use, such that distractions to the archer's concentration are avoided.

SUMMARY OF THE INVENTION

It is an object of the present invention to provide a carry system for an archery bow which is self-storing, and automatic in its operation so as to avoid distraction to an archer's concentration.

Another object of this invention to provide a carry system of the above-described type which automatically accommodates a wide range of user's movements, such as climbing and running, without requiring attention or direct intervention from the user.

These and other objects of the present invention, which will become apparent from the appended description and drawings, are provided in a carry system for an archery bow having upper and lower bow limbs mounted on opposed ends of an intermediate bow riser, the upper and lower bow limbs generally colinearly aligned with one another along a bow center line when viewed from the front of the bow, the carry system comprising:

a housing defining a hollow cavity and an opening;

a spool rotatably mounted within the housing;

flexible webbing disposed on the spool and passing through the opening in the housing; and a leg extending at an acute angle from the housing, having an opening for mounting to the bow, the aperture spaced from the housing cavity and located substantially to one side of said webbing, such that the webbing is located to one side of the bow center line.

DETAILED DESCRIPTION OF THE PREFERRED EMBODIMENT

Figure 1:
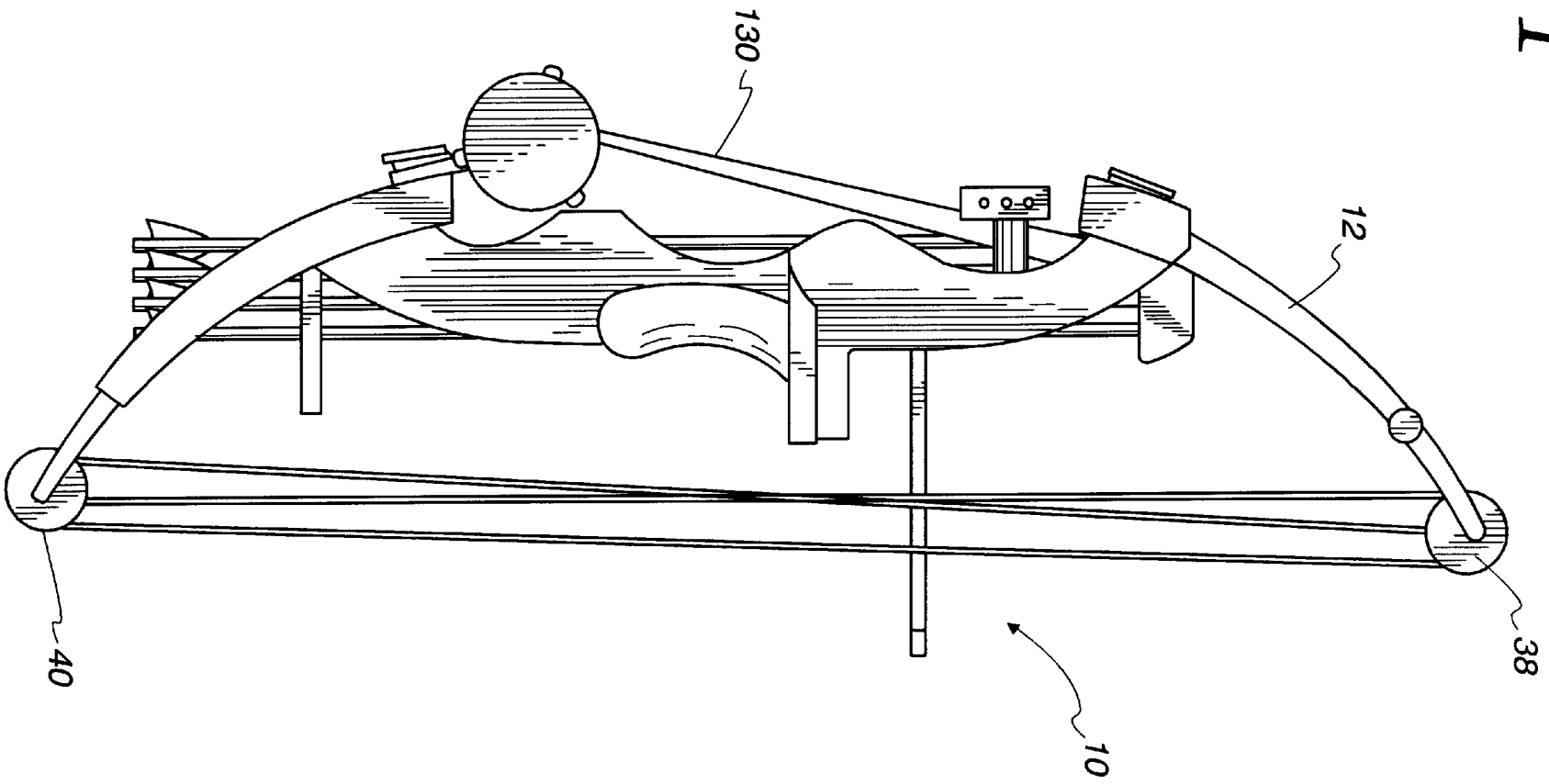
FIG. 1 is a side elevation of a bow carry system shown attached to a conventional compound bow.
Figure 2:
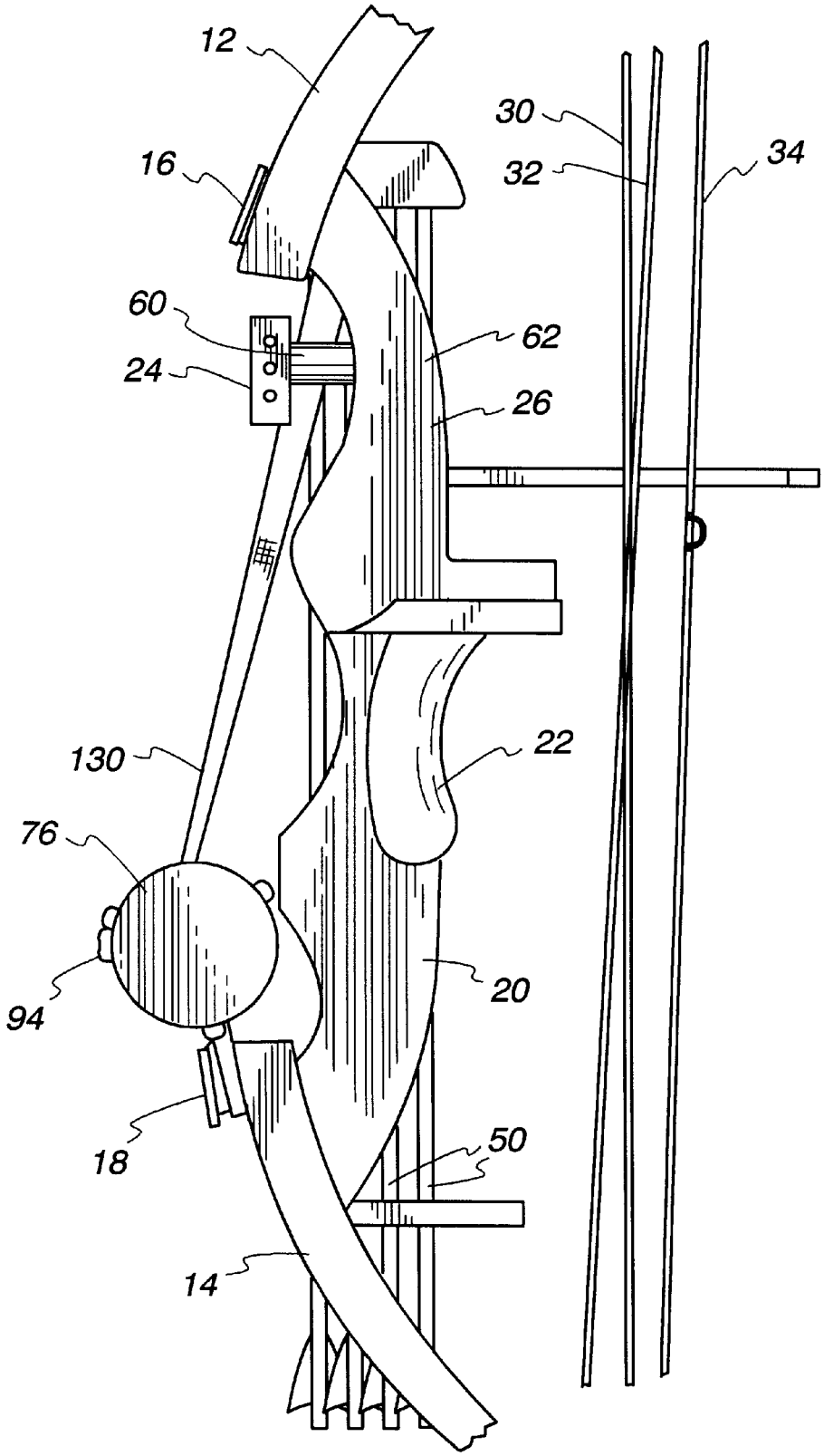
FIG. 2 is a fragmentary side elevational view, taken on an enlarged scale, of a compound bow having a different construction.
Figure 3:
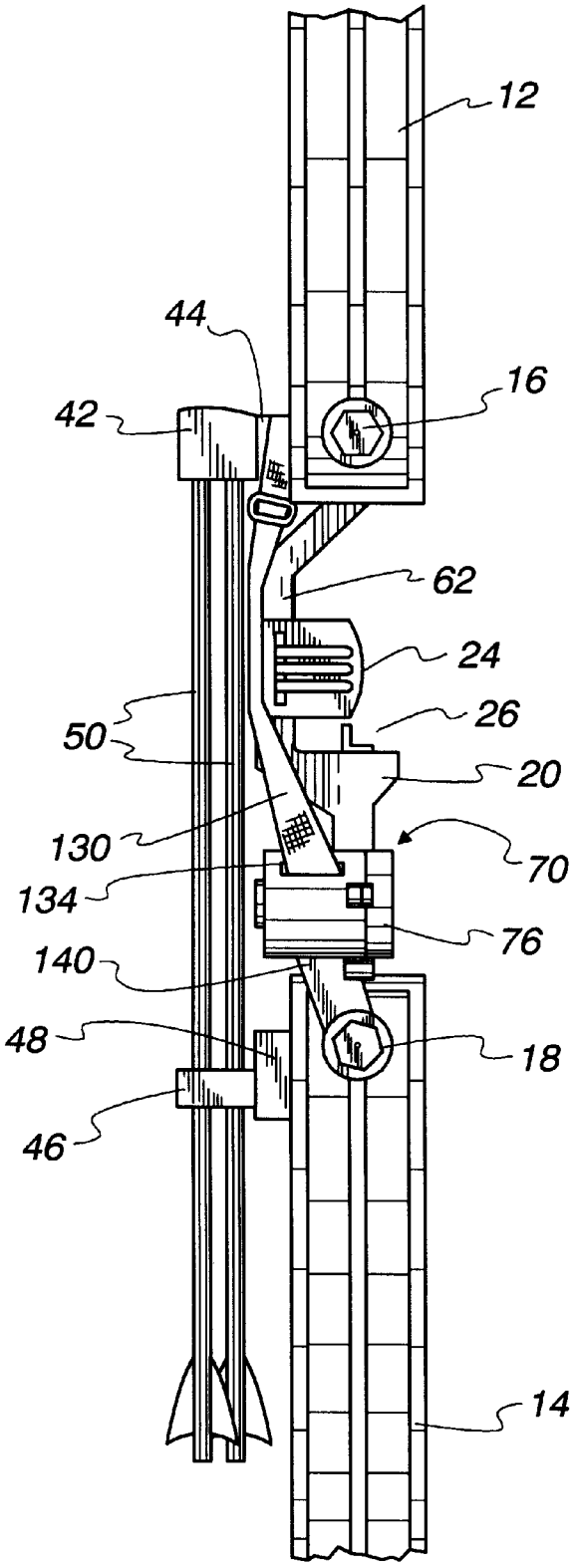
FIG. 3 is a fragmentary front view thereof.

Referring now to the drawings, and initially to FIGS. 1–3, a compound bow of conventional construction is generally indicated at 10. The compound bow 10 includes upper and lower limbs 12, 14 attached by bolt fasteners 16, 18 to opposite ends of a rigid handle or riser 20. Riser 20 includes a grip or palm rest 22 and a sight 24 located in a sight window 26 at the upper end of riser 20. Draw cables 30, 32 and a bow string 34 are suspended between cable wheels 38, 40, pivotally mounted at the free ends of limbs 12, 14.

In older times an archer would carry arrows in a quiver slung over the archer's back. However, modern archers, especially those using state-of-the-art compound bows, find it convenient to use a two-piece storage rack mounted to the bow limbs, adjacent the connecting bolts 16, 18. The carrying rack includes an upper portion 42 secured to the mounting bolt 16 by a stand-off 44. A lower component 46 is secured to the lower mounting bolt 18 by stand-off 48. In this manner, a plurality of arrows 50 can be mounted to one side of riser 20 without interfering with the archer's grip, line of sight or arrow release.

As can be seen in FIG. 3, the bow limbs 12, 14 are colinearly aligned, and the riser 20 has its major mid-portion shifted to the left side (when viewed from the front, as illustrated in FIG. 3). Thus, the sight window 26 is opened from the right hand side of FIG. 3. Thus, arrows can be conveniently laterally inserted in the sight window without requiring the arrows to be threaded through a ring-like opening. Referring to FIGS. 2 and 3, it can be seen that the sight 24 is mounted by a stand-off 60 to a laterally off-set vertical portion 62.

Figure 7:
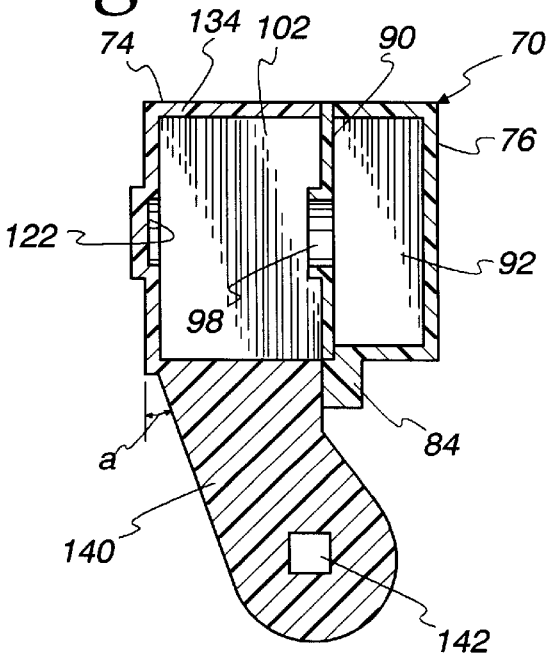
FIG. 7 is a cross-sectional view taken along the line 7—7 of FIG. 6.
Figure 8:
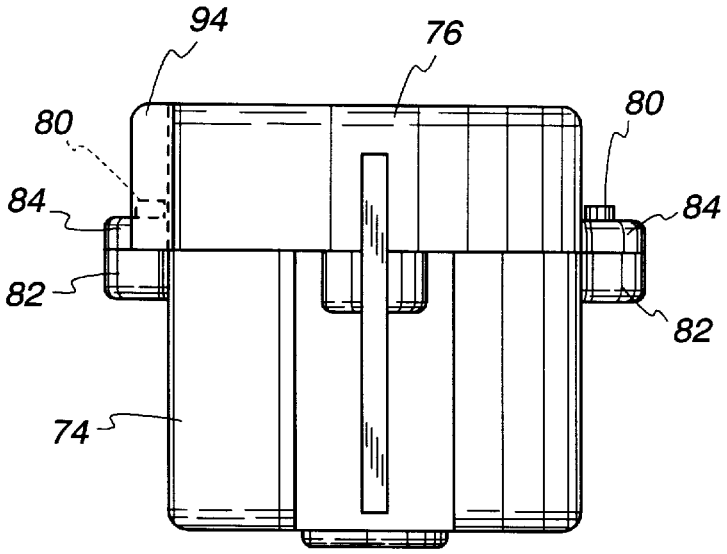
FIG. 8 is a bottom plan view thereof.
Figures 10, 11:
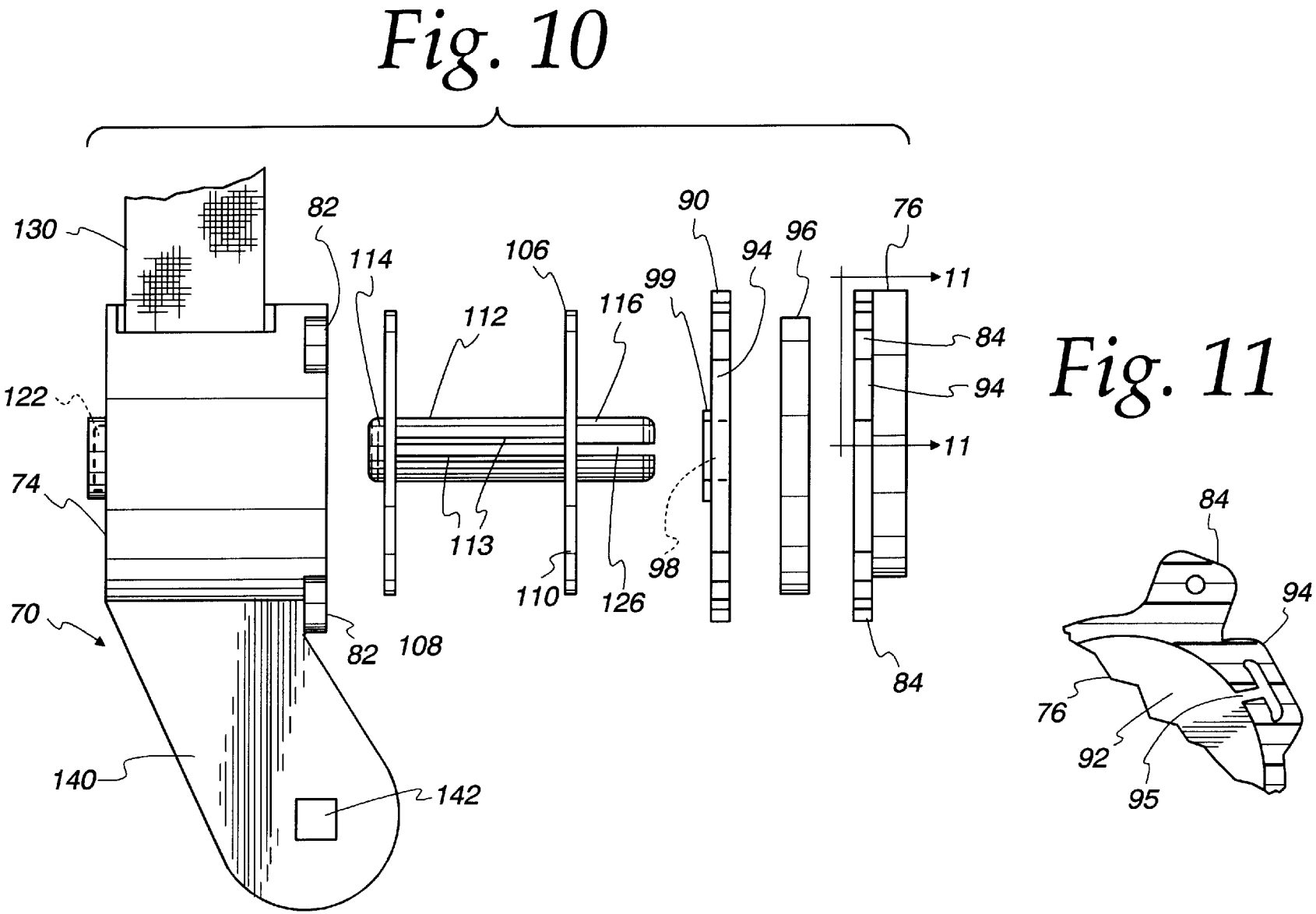
FIG. 10 is an exploded view of the retractor.
FIG. 11 is a fragmentary view taken along the line 11—11 of FIG. 10.

The carrying system according to principles of the present invention is generally indicated at 70 and includes a two-part housing defining a hollow interior. The housing is comprised of housing portions 74, 76. With additional reference to FIGS. 5–8, housing portions 74, 76 are preferably formed as two separate parts, held together by screw fasteners 80 inserted through mounting lugs 82, 84 formed on the housing portions. With reference to FIG. 7, a washer-like partition wall 90 is provided on housing portion 76 and defines a cavity 92 for receiving the inner end of a coil spring 96 (shown in FIG. 10). An upwelling or protruding cavity 94 (as can be seen, for example, in FIGS. 4 and 5) is formed in housing portion 76 and partition wall 90. A slot is formed in upwelling 94 of the housing portion 76, so as to extend in a direction parallel to the axis of spool 106. The coil spring has an outer end which is bent so as to be received in the slot formed in the upwelling of housing portion 76. The upwelling in partition wall 90 closes off the slot so as to hold the outer end captive within the upwelling formed in housing portion 76. Thus, the tension on the spring may be conveniently adjusted by a user, by simply removing the screws 80 and rotating housing portion 76 until the ears 82, 84 are again brought into alignment with one another, whereupon the screw fasteners can be reinserted. As can be seen in FIG. 11, the slot 95 has a generally T-shaped configuration and opens into the major cavity portion 92 of the housing part.

Figure 9:
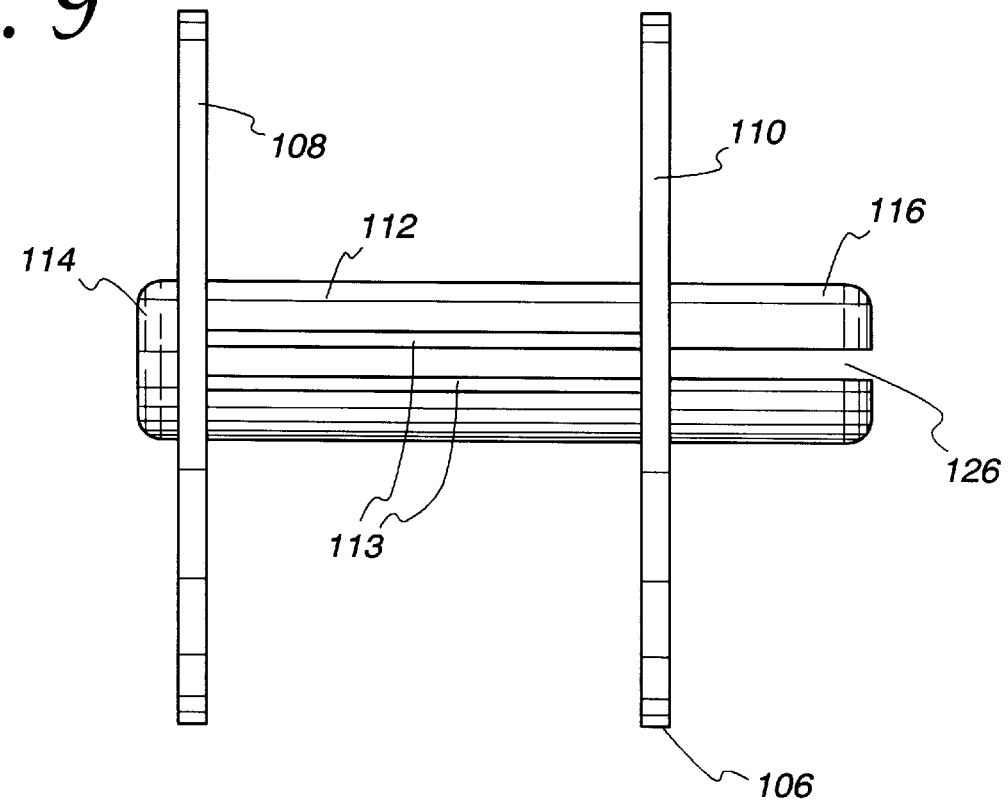
FIG. 9 is a front view of the internal reel portion of the carry system.

The central aperture 98 is formed in partition wall 90 and provides communication with the cavity 102 formed in housing portion 74. Referring to FIG. 9, a spool or reel 106 includes flanges 108, 110 and a central hub 112, having end portions 114, 116. End portion 114 is received in protrusion 122 formed in housing portion 74 (see FIG. 7). End portion 116 of the spool is inserted through opening 98 in partition wall 90 (see FIG. 7) so as to enter cavity 92 of housing portion 76. As can be seen in FIG. 10, a disk-like raised portion or shoulder 99 encircles the opening 98 of partition wall 90. With the components of FIG. 10 assembled together, bushing 99 is located immediately adjacent the opposed face of spool flange 110 so as to minimize the area of surface contact between spool flange 110 and partition wall 90, and so as to help maintain spool 106 in desired alignment with respect to the assembled housing portions. Further, bushing 99 is located immediately adjacent spring 96 so as to provide effective support for the spool immediately adjacent the point on hub 112 where spring force is applied at a small distance from the center line of the hub. As can be seen in FIG. 9, end portion 116 has a central slit 126 for receiving the radial inner end of a spiral wound flat spring, as is known in the art. The spiral spring is wound by rotating housing portion 74 with respect to housing portion 76 so as to store a torsional bias force for the spool. With reference to FIGS. 1–3, a webbing or strap 130 which is wound about spool 106 and is passed through an opening 134 formed in housing portion 74 (see FIGS. 3 and 7).

Figure 4:
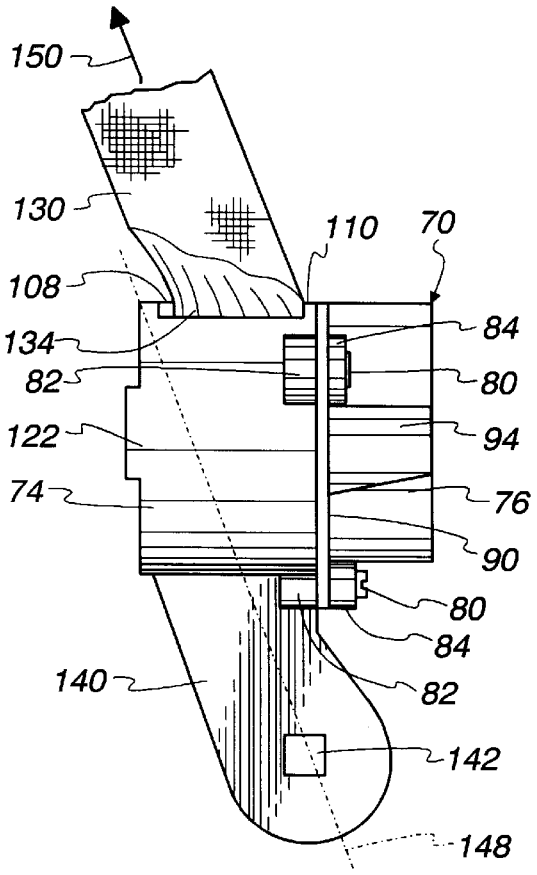
FIG. 4 shows the retractor portion of FIG. 3 on an enlarged scale.
Figure 6:
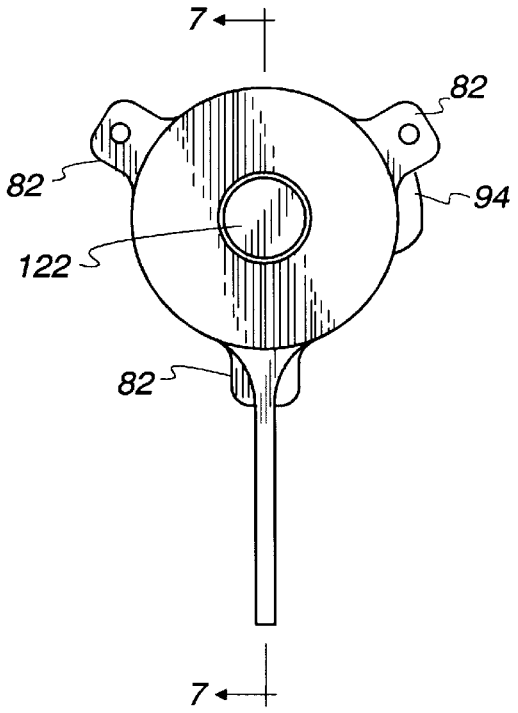
FIG. 6 is a side elevational view from the left side of FIG. 4.
Figure 5:
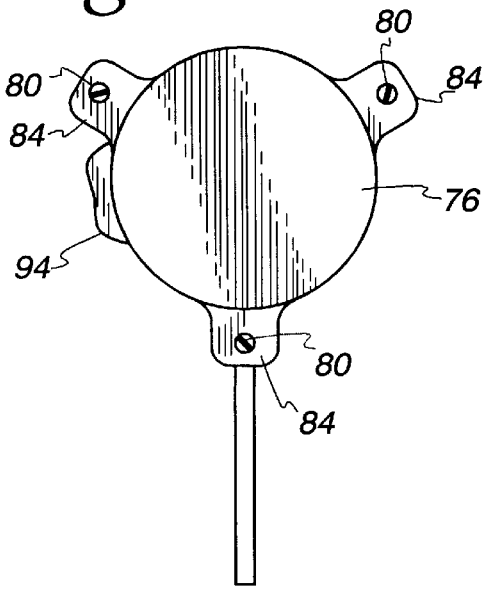
FIG. 5 is an elevational view from the right side of FIG. 4.

With reference to FIGS. 4 and 7, housing portion 74 includes an offset leg 140 having a mounting aperture 142 for receiving bolt fastener 18 (see FIG. 3). With reference to FIG. 7, the offset leg 140 forms an angle a of approximately 20 degrees. Referring to FIG. 4, the center line of offset leg 140 is indicated by construction line 148. As can be seen in FIG. 4, construction line 148 passes through the webbing-receiving cavity 102 and extends generally parallel to the direction of webbing payout indicated by arrow 150.

Referring to FIGS. 2 and 3, and especially to FIG. 3, webbing 130 is trained at an angle to the center line of bow limbs 12, 14. The angle of payout of webbing 130 is defined by stand-off 60 which secures sight 24 to the bow riser. As can be seen in FIG. 3, webbing 130 passes over stand-off 60 and is terminated in a loop securement to stand-off 44. Preferably, a conventional buckle fastener secures the free end of webbing 130 in the loop about stand-off 44. As can be seen from FIGS. 3 and 4, the aperture 142 is aligned with the center line of bow limbs 12, 14, through which bolt fastener 18 passes. As can be seen from FIG. 4, substantially all of the webbing is located to one side of aperture 142, i.e., the left side of FIG. 3.

Clearly, the webbing and reel are not centered about the bow, but rather are laterally shifted to one side of the bow. Webbing 130 is sufficiently flexible so as to allow portions exiting opening 134 to immediately take on the acute angle inclination as shown in FIG. 3. It is preferred that the flanges 108, 110 of the reel (see FIG. 9) be made as large as possible, such that the outer edge of the flanges comes very close to the window 134, so as to guide the webbing paid out from the spool as it is inclined at an acute angle. This ensures that the webbing will be smoothly paid out and subsequently retracted under the force of the bias spring.

As can be seen in FIG. 3, the angular offset of leg 140 adds securement to the lower bow limb and provides a stable directionally oriented payout which minimizes sideways strain on the webbing. As a result, when a user's arm is inserted between the webbing and riser 20, webbing is readily paid out of the spool within housing portion 74 and provides little or no resistance to the user. As the bow is carried about in the field, tension on the webbing is constantly adjusted by the spring stored in housing portion 76 and has been found to maintain a snug engagement with the user's torso, even during extreme movement such as climbing and running, for example.

When use of the bow is desired, the user simply slips his arm between the webbing and the bow riser and the webbing is immediately retracted during withdrawal of the user's shoulder and arm. It has been found that no matter how quickly the bow is dismounted, and no matter how quickly the user controls the handle 22 of the bow riser, webbing 130 is fully retracted long before an arrow is mounted to the bow string 34. Even if the components of the carry system become damaged such that the webbing does not quickly retract, it can be seen from FIG. 3 that the webbing is maintained entirely outside of the sight window and the opening of the sight window through which an arrow is laterally inserted.

Certain variations are possible. For example, the housing portions 74, 76 can, with reference to FIG. 7, be rotated in a clockwise direction by an amount approximately equal to the angle a, although such has not been found necessary, and in general has been found to result in a less pleasing appearance.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A retractable sling assembly for an archery bow having upper and lower bow limbs mounted on opposed ends of an intermediate bow riser, the upper and lower bow limbs generally colinearly aligned with one another along a bow center line when viewed from the front of the bow, the carry system comprising:

a housing defining a hollow cavity and an opening;

a spool rotatably mounted within the housing;

flexible webbing disposed on the spool and passing through the opening in the housing, said flexible webbing having a free end with means for mounting to a first portion of the bow; and a leg extending at an acute angle from the housing, having an aperture for mounting to a second portion of the bow, the aperture spaced from the housing cavity and located substantially to one side of said webbing, such that the webbing spanning the first and second portions of the bow to form a sling is located to one side of the bow center line.

2. The retractable sling assembly of claim 1, further comprising a bow riser including a vertical wall laterally offset from the bow center line, and a sight means, with the vertical wall passing between the flexible webbing and the sight means.

3. The retractable sling assembly of claim 1, further comprising spring bias means within the housing for rotationally biasing said spool.

4. The retractable sling assembly of claim 3, further comprising a partition wall between said spool and said spring.

5. The retractable sling assembly of claim 4 wherein said housing includes a body portion removably joined to a cap portion carrying said partition wall.

6. The retractable sling assembly of claim 1 wherein said webbing has a free end portion with a buckle fastener for coupling the webbing free end portion to at least one of said riser and said bow limbs.

7. The retractable sling assembly of claim 1, wherein said mounting means comprises a buckle fastener for coupling the webbing free end to at least one of said riser and said bow limbs.

8. A retractable sling assembly for an archery bow having upper and lower bow limbs mounted on opposed ends of an intermediate bow riser, the upper and lower bow limbs generally colinearly aligned with one another along a bow center line when viewed from the front of the bow, the carry system comprising:

a housing defining a hollow cavity and an opening;

a spool rotatably mounted within the housing;

flexible webbing disposed on the spool and passing through the opening in the housing, said flexible webbing having a free end with mounting means for mounting to a first portion of the bow;

said mounting means comprising a buckle fastener for coupling the webbing free end to at least one of said riser and said bow limbs; and a leg extending at an acute angle from the housing, having an aperture for mounting to a second portion of the bow, the aperture spaced from the housing cavity and located substantially to one side of said webbing, such that the webbing spanning the first and second portions of the bow to form a sling, is located to one side of the bow center line.

* * * * *